US005431581A

United States Patent [19]

Laudereau

[11] Patent Number: 5,431,581

[45] Date of Patent: Jul. 11, 1995

[54] TERMINAL BLOCK MOUNTING DEVICE

[75] Inventor: Guy Laudereau, Valbonne, France

[73] Assignee: Telemecanique, Rueil Malmaison, France

[21] Appl. No.: 315,351

[22] Filed: Sep. 30, 1994

Related U.S. Application Data

[62] Division of Ser. No. 84,128, Jul. 1, 1993, Pat. No. 5,370,548.

[30] Foreign Application Priority Data

Jul. 10, 1992 [FR] France ..... 92 08752

[51] Int. Cl.[6] ..... H01R 4/50

[52] U.S. Cl. ..... 439/341; 439/681

[58] Field of Search ..... 439/338, 341, 680, 681, 439/677, 633, 676

[56] References Cited

U.S. PATENT DOCUMENTS

| | | | |
|---|---|---|---|
| 2,217,496 | 10/1940 | Riley | 439/475 |
| 3,426,315 | 2/1969 | De Tar | 439/681 |
| 3,668,605 | 6/1972 | Albert | 439/376 |
| 3,984,169 | 10/1976 | Amstrong et al. | 439/341 |
| 5,273,462 | 12/1993 | Huser et al. | 439/341 |

*Primary Examiner*—Neil Abrams
*Assistant Examiner*—Hien D. Vu
*Attorney, Agent, or Firm*—Oblon, Spivak, McClelland, Maier & Neustadt

[57] ABSTRACT

In a device for pivotally mounting a terminal block on a support, in particular on an interface module case in a programmable controller, the terminal block is mounted on the support by nesting engagement with a rotary member articulated to the support. The articulated member and the terminal block carry complementary coding pegs associated by movement in translation.

5 Claims, 2 Drawing Sheets

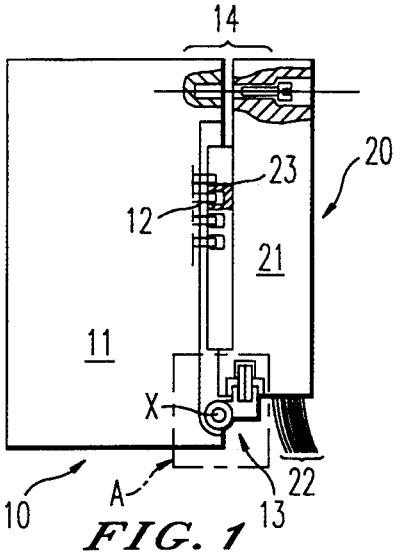
FIG. 1
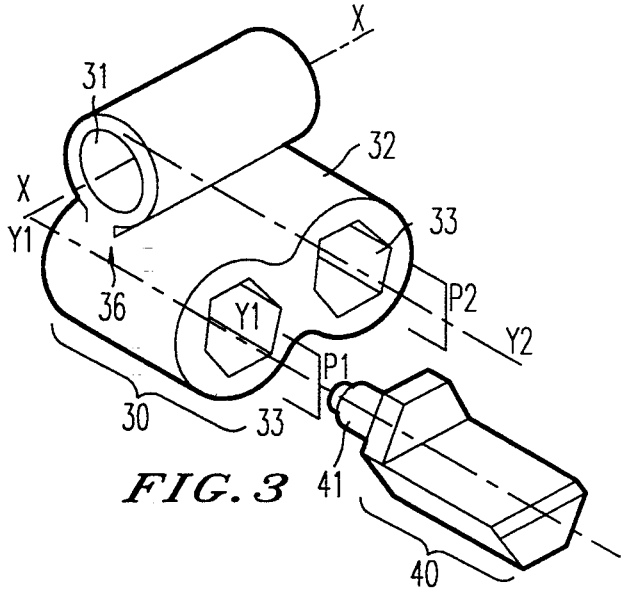
FIG. 3
FIG. 4
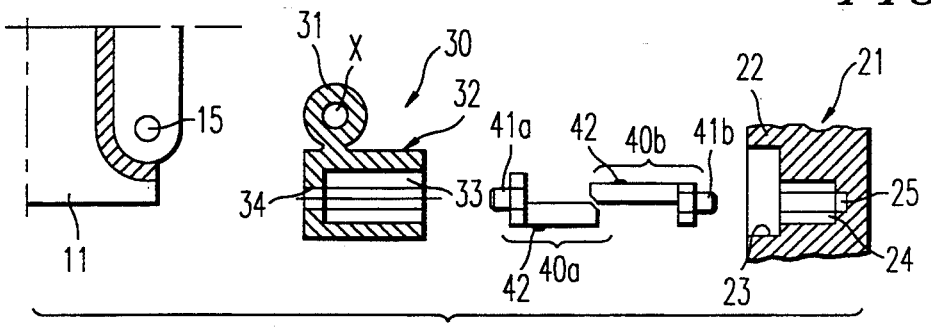
FIG. 2
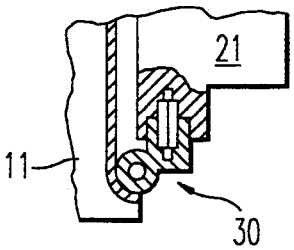
FIG. 6
FIG. 5
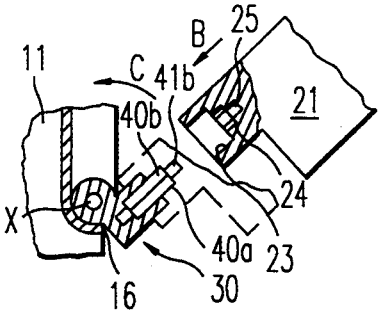
FIG. 7
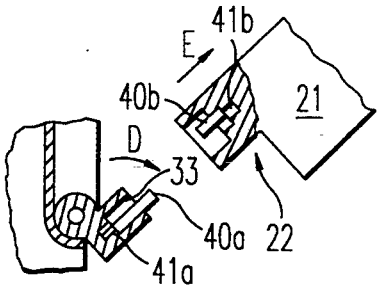

TERMINAL BLOCK MOUNTING DEVICE

This is a division of application Ser. No. 08/084,128, filed on Jul. 1, 1993, now U.S. Pat. No. 5,370,548.

BACKGROUND OF THE INVENTION

1. Field of the Invention

The present invention concerns a device for mounting a terminal block or a connector on a support. The device has a polarizer facility. A device of this kind is more particularly although not exclusively usable to mount a terminal block on an interface module in a programmable controller.

2. Description of the prior art

It is known from U.S. Pat. No. 3,984,169 to use a device for pivotally mounting a connection member on an electrical equipment support such as a distribution board. To prevent an inappropriate connection member being mounted on the support coding means in the form of projections and notches are provided on a fixed pivot shaft and on a bearing part fastened to the pivoting member. The coding means provide the required polarizer function; the pivot and coding means of this device are somewhat inconvenient, however.

An object of the invention is to provide a device for pivotally mounting a terminal block on a support which clearly distinguishes between movement of the terminal block which is part of the polarizer function and its pivoting movement which is part of the connection function.

Another object of the invention is to prevent damage to the terminal block or to the support assembly in the event of a mounting error.

SUMMARY OF THE INVENTION

The present invention consists in a device for mounting a terminal block on a support, for example an electronic module case, said terminal block being adapted to be connected electrically to said support by connection members and fixed to said support by fixing members, the device comprising:

- a bearing part by which said terminal block is pivotally mounted on said case of said support and comprising a member carried by said case of said support and articulated to said terminal block or carried by and articulated to the body of said terminal block and adapted to be rotated by said terminal block or said support during mounting of said terminal block on said support, and

- mechanical coding means associated with said support and with said terminal block to prevent mounting of an inappropriate terminal block on said module, said articulated member carrying a first part of said coding means and said terminal block or said case on said support carrying a second part of said coding means complementary to said first part.

The terminal block is preferably nested on the articulated coding member and the coding means are mutually interengageable in the direction of translatory movement of the terminal block relative to the articulated member, this direction lying in a plane perpendicular to the articulation axis. The cooperating translatory movement guide surfaces are advantageously located and adapted to eliminate torque on the articulated member during such translatory movement.

The features and advantages of the invention will emerge from the following description with reference to the appended drawings of one non-limiting embodiment of the invention.

BRIEF DESCRIPTION OF THE DRAWINGS

FIG. 1 is a diagrammatic side view of a programmably controller interface module fitted with a terminal block.

FIG. 2 is an exploded view on a larger scale of the part of FIG. 1 marked A.

FIGS. 3 and 4 are respectively perspective views of the articulated member and an associated coding peg.

FIGS. 5 through 7 show the part A of the terminal block bearing respectively before mounting the terminal block, when the terminal block is mounted and after demounting the terminal block.

DESCRIPTION OF THE PREFERRED EMBODIMENT

Figure 8:
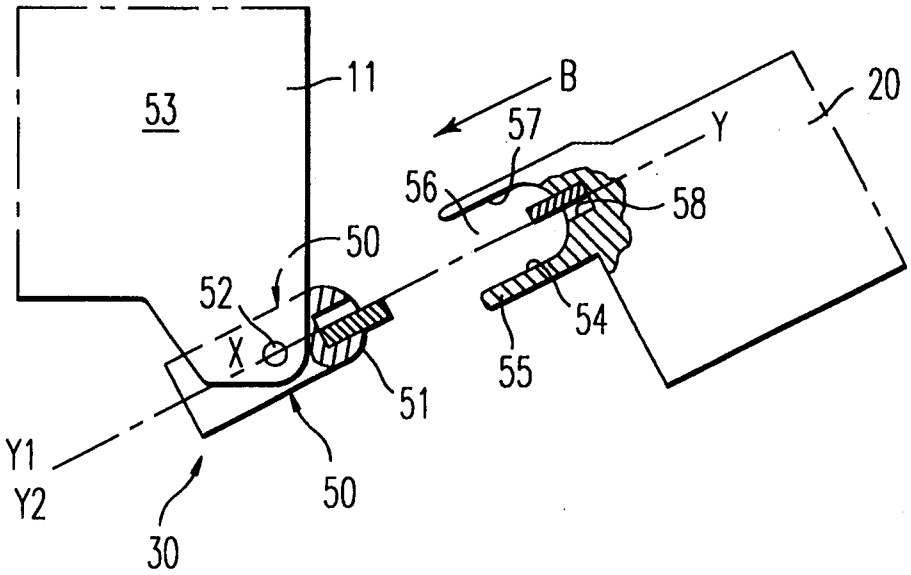
FIG. 8 shows a preferred embodiment of the invention.

The device shown in FIG. 1 is for pivotally mounting a terminal block to the front of an interface module in a programmable controller or like automation equipment.

The interface module 10 is fixed by any known means to a base or support member (not shown) and provides an interface between a programmed electronic processor unit and an automated system comprising input members such as sensors and output members such as relays.

The module 10 has a case 11 with male connection members 12 on its front surface and in its lower part a bearing 13 with a horizontal axis X about which the terminal block 20 pivots. The terminal block 20 comprises a body 21 which is fitted to the bearing 13, the bearing is oriented in an inclined position before it is connected to terminal block 20 and pivoted to the position shown in FIG. 1 and fixed to the case 11 by fixing means 14. Cables connected to the input and output members of the automated system are electrically connected to an electronic circuit of the module 10 by female connection members 23 which may be grouped together in a connector, for example, and cooperate with the connection members 12. The terminal block may be demounted from and remounted on the module without disturbing the wiring.

To prevent an inappropriate terminal block from being mounted on the interface module in question, while ensuring that the terminal block is a standardized product to the greatest possible extent, a bearing 13 is used which has an articulated member 30 prefitted with coding pegs 40.

The articulated member 30 has three functions: to support the coding pegs, to nest with the terminal block and to provide a bearing for the latter. It has a bearing member 31 with an axis X which cooperates with a shaft or pivot 15 fixed relative to the case 11 and a body 32 which has two housings 33 with parallel axes Y1, Y2 which lie in planes P1, P2 perpendicular to the X axis. The housings 33 are prism-shape, having a hexagonal cross-section, for example, and each leads to a small cylindrical orifice 34. Each housing 33 initially receives a pair of coding pegs 40*a*, 40*b* (see FIG. 2) indexed in rotation about the respective axis Y1, Y2. The bearing member 31 mounts on the shaft 15 and is joined to the body 32 by a weakened area 36 which is adapted to break if an excessive force is applied to the member 30.

Each coding peg 40 is generally prism-shape with a truncated hexagonal cross-section so as to function as a mechanical polarizer in the familiar way, for example as disclosed in U.S. Pat. No. 3,426,315. The peg 40 has a nipple 41 at one end. The body 21 of the terminal block has in its lower part a part 22 adapted to cooperate with the rotary member. This part 22 has two housings opening into a nesting opening 23 on the respective projecting part of the body 32 of the member 30; each housing has a prism-shaped opening 24 of hexagonal cross-section which opens at one side into the opening 23 and at the opposite side into a small cylindrical orifice 25. The nipples 41*a*, 41*b* on the pegs 40*a*, 40*b* respectively cooperate with the orifices 34 of the rotary member and the orifices 25 of the terminal block in a force fit arrangement. Each peg of a pair has a detent or like retaining member 42 so that it remains fixed to the associated part—i.e. the support or terminal block—despite extraction forces communicated to it by the other peg of the pair.

The mounting and polarizer device shown operates as indicated in FIGS. 5 through 7.

FIG. 5 shows the articulated coding member in an inclined position butted up against a shoulder 16 of the case 11. The member 30 carries the two pairs of complementary pegs (40*a*, 40*b*) force fitted in the housings 33. When the body 21 of the terminal block 20 is engaged on the articulated member 30 by translation movement in the direction of the arrow B it is force fitted through the opening 23 over the body 32 of the rotary member and the pegs 40*a*, 40*b* are inserted into the hexagonal orifice 24 until the nipple 41*b* on the peg 40*b* is forcibly engaged in the orifice 25. Thereafter the body 21 of the terminal block may be pivoted about the X axis in the direction of the arrow C to the normal position of use shown in FIG. 6; in this position the fixing members may be tightened.

To demount the terminal block, it is pivoted in the direction of the arrow D (FIG. 7) and then pulled off by movement in translation in the direction of the arrow E. The peg 40*a* is retained in the housing 33 by its nipple 41*a* and its detent 42. The peg 40*b* is held in the housing 24 by its nipple 41*b* and its detent 42. The indexing of the pegs then ensures that only a terminal block equipped with pegs 40*b* correctly indexed relative to the pegs 40*a* can be mounted on the module.

The two pairs of coding parts provide 36 coding possibilities, in the known manner. It is obvious that a different number of coding possibilities can be achieved by varying the number and shape of the coding parts.

Usual indications such as numbers may be associated with the coding peg housings. Although the articulated coding member 30 may be attached to the terminal block it is preferable for it to be attached to the interface module, as described; this enables association of a standard terminal block with different modules. The terminal block may be fastened to the articulated coding in insnap-fastener fashion.

In the preferred embodiment shown in FIG. 8 the articulated member 30 is a barrel with plane surfaces 50 adjacent a convex surface 51 into which open the housings 33 adapted to receive the coding pegs with axes Y1, Y2. The barrel has journals 52 with axis X coplanar and perpendicular to the axes Y1, Y2; the journals are removably engaged in housings on flanges 53 of the case 11 of the interface module so that they can pivot relative to the module about the X axis.

The terminal block 20 comprises guide members adapted to cooperate with the plane surfaces 50 of the barrel. In this embodiment the guide members are the plane interior surfaces 54 of skirts 55 around an opening 56 to enable nesting in direction B. The openings 58 for the pegs open into the concave back 57 of the opening 56. The skirts 55 locate between the two flanges 53. The terminal block may therefore be engaged with the barrel with the required precision. Because of the elasticity of the flanges 53 the journals 52 of the barrel may disengage from their housings if the terminal block transmits excessive thrust forces to the flanges.

There is claimed:

1. Device for mounting a terminal block on a support, said terminal block being connected electrically to said support by connection members and fixed to said support by fixing members, the device comprising:

a pivot member by which said terminal block is pivotally mounted on said support and including an articulated member which is articulated to one of said support and said terminal block, and a coding mechanism having a first and second part connected with said support and said terminal block, respectively, said coding mechanism preventing mounting of an inappropriate terminal block on said module, wherein said second part is engageable with said first part, said articulated member is articulated about an articulation axis, said terminal block is positioned on said articulated member by movement in translation in a plane perpendicular to said articulation axis, and said first part and second part of said coding mechanism are mutually interengageable in the direction of said movement in translation and wherein said terminal block of said movement in translation and wherein said terminal block has guide surfaces and said articulated member has cooperating surfaces to be inserted into said guide surfaces, said guide surfaces eliminating torque on said articulated member during insertion of said cooperating surfaces into said guide surfaces.

2. Mounting device according to claim 1 wherein said terminal block is postionable on said articulated member.

3. Device for mounting a terminal block on a support, said terminal block being connected electrically to said support by connection members and fixed to said support by fixing members, the device comprising:

a pivot member by which said terminal block is pivotally mounted on said support and including an articulated member which is articulated to one of said support and said terminal block, and a coding mechanism having a first and second part connected with said support and said terminal block, respectively, said coding mechanism preventing mounting of an inappropriate terminal block on said module, wherein said second part is engageable with said first part, said articulated member is articulated about an articulation axis, said terminal block is positioned on said articulated member by movement in translation in a plane perpendicular to said articulation axis, and said first part and second part of said coding mechanism are mutually inteerengageable in the direction of said movement in translation wherein said first and second part of said coating mechanism comprise a pair of pegs indexable by rotation about a peg indexing axis and wherein said peg indexing axis is located in proximity with said articulated axis.

4. Device for mounting a terminal block on a support, said terminal block being connected electrically to said support by connection members and fixed to said support by fixing members, the device comprising:

a pivot member by which said terminal block is pivotally mounted on said support and including an articulated member which is articulated to one of said support and said terminal block, and a coding mechanism having a first and second part connected with said support and said terminal block, respectively, said coding mechanism preventing mounting of an inappropriate terminal block on said module, wherein said second part is engageable with said first part, said articulated member is articulated about an articulation axis, said terminal block is positioned on said articulated member by movement in translation in a plane perpendicular to said articulation axis, and said first part and second part of said coding mechanism are mutually interengageable in the direction of said movement in translation and wherein said articulated member comprises a barrel having plane surfaces adjacent a convex surface onto which open recesses adapted to receive said coding mechanism, said terminal block comprises translatory movement guide members located in proximity with a concave surface into which open recesses adapted to receive said coding mechanism and said translatory movement guide members cooperate with said plane surfaces of said barrel.

5. Device for mounting a terminal block on a support having at least one flange, said terminal block being connected electrically to said support by connection members and fixed to said support by fixing members, the device comprising:

a pivot member by which said terminal block is pivotally mounted on said support and including an articulated member which is articulated to one of said support and said terminal block, and a coding mechanism having a first and second part connected with said support and said terminal block, respectively, said coding mechanism preventing mounting of an inappropriate terminal block on said module, wherein said second part is engageable with said first part, said terminal block is positioned on said articulated member by movement in translation in a plane perpendicular to said articulation axis, and said first part and second part of said coding mechanism are mutually interengageable in the direction of said movement in translation and wherein said articulated member has at least one journal positioned in a housing wherein the journal disengages from the housing upon said terminal block transmitting excessive thrust forces to said at least one flange of said support.

* * * * *